US007398723B1

(12) United States Patent
Blakley

(10) Patent No.: US 7,398,723 B1
(45) Date of Patent: Jul. 15, 2008

(54) TRIGGER FORWARD DISPLACEMENT SYSTEM AND METHOD

(76) Inventor: Brian A. Blakley, 8971 - 67th St. N., Pinellas Park, FL (US) 33782

( * ) Notice: Subject to any disclaimer, the term of this patent is extended or adjusted under 35 U.S.C. 154(b) by 516 days.

(21) Appl. No.: 10/424,676

(22) Filed: Apr. 25, 2003

(51) Int. Cl.
*F41A 19/02* (2006.01)

(52) U.S. Cl. ..... 89/129.01; 89/129.02; 89/130; 89/131; 42/69.01

(58) Field of Classification Search ..... 42/69.01, 42/70.06; 89/128–131, 129.01, 129.02
See application file for complete search history.

(56) References Cited

U.S. PATENT DOCUMENTS 4,023,465 A * 5/1977 Inskip ..... 89/131
4,057,003 A * 11/1977 Atchisson ..... 89/138
4,463,654 A * 8/1984 Barnes et al. ..... 89/128
4,580,484 A * 4/1986 Moore ..... 89/128
4,697,495 A * 10/1987 Beretta ..... 89/143
4,787,288 A * 11/1988 Miller ..... 89/27.3
5,614,691 A * 3/1997 Taylor ..... 89/128
6,101,918 A * 8/2000 Akins ..... 89/129.01

* cited by examiner

*Primary Examiner*—Troy Chambers
(74) *Attorney, Agent, or Firm*—Edward P Dutkiewicz

(57) ABSTRACT

A semi-automatic firearm has forward and rearward ends. A receiver has a safety selector aperture, a barrel, a reciprocating loading mechanism and a magazine. A trigger finger and inner portions. The inner portion has a seat with a groove. A disconnector has a hammer hook coupled to the trigger. A trigger mounting pin couples the trigger to the firearm. A trigger disconnector spring couples the trigger and the disconnector. A hammer having an upper striking portion with a disconnector hook receptacle. A hammer mounting pin couples the hammer to the firearm. A hammer spring is coupled to the hammer and hammer mounting pin. A cam body subassembly comprises a cam body housing, a cam and a cam mounting pin. The cam body subassembly is coupled to the firearm. A safety selector is coupled to the firearm. A trigger extender is mated with the upward trigger groove.

1 Claim, 5 Drawing Sheets

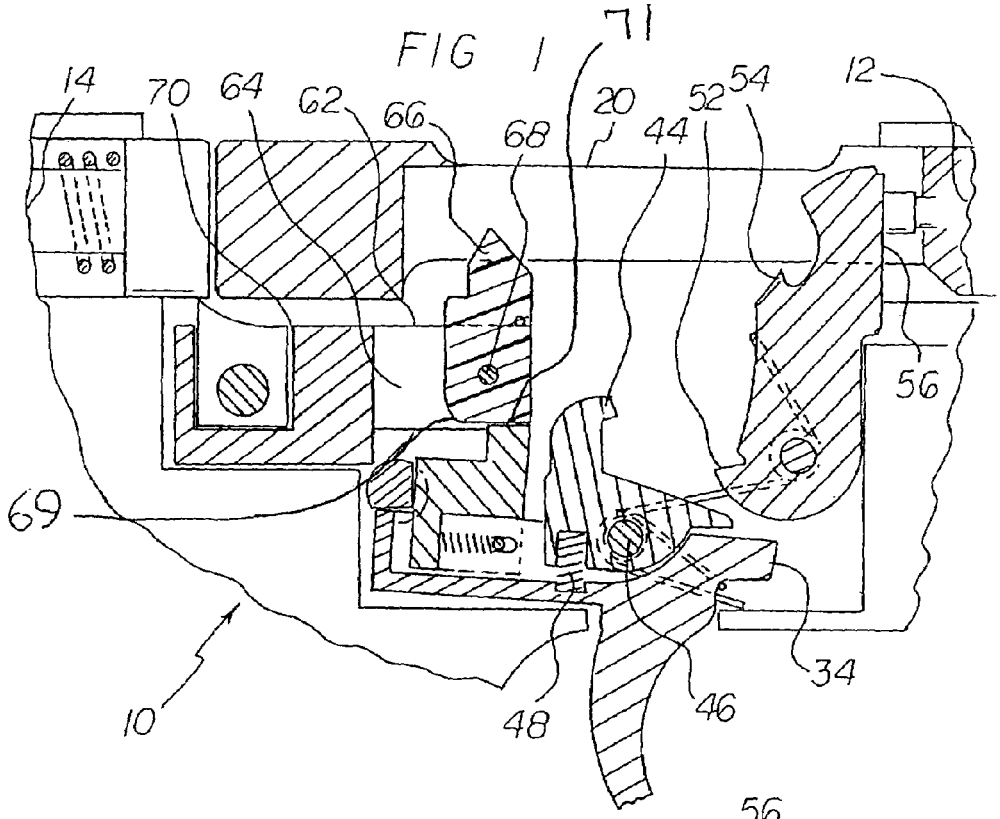
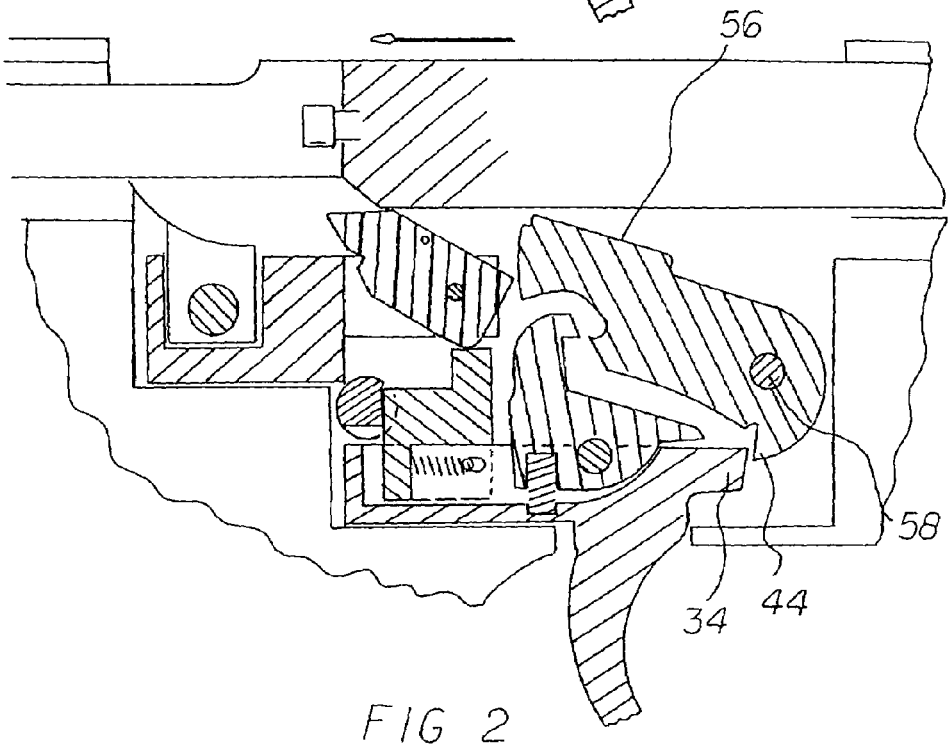
FIG 2

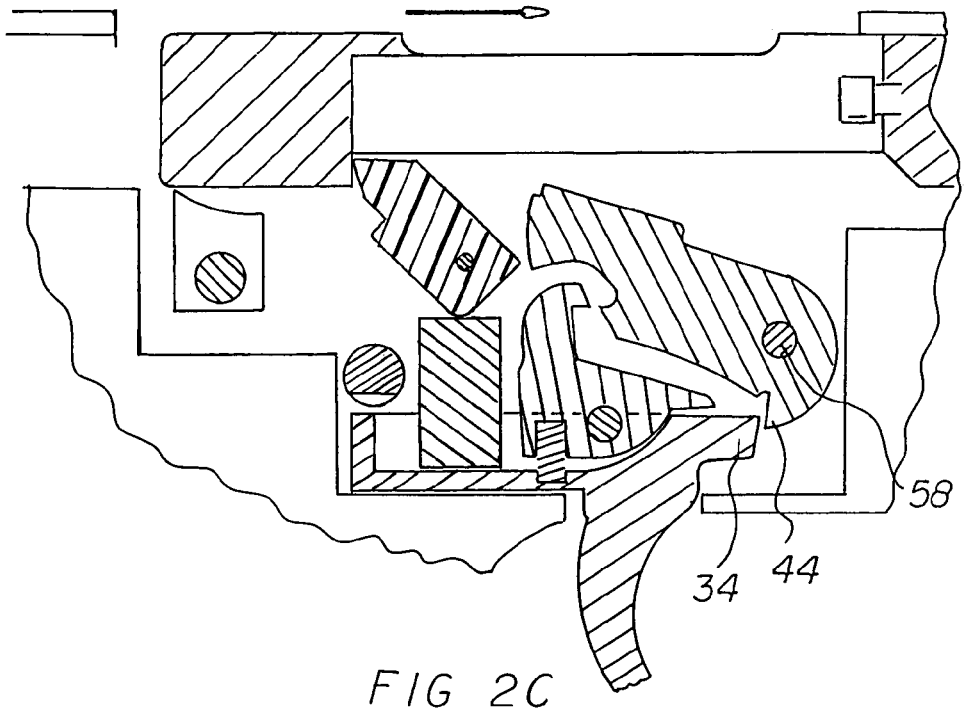
FIG 2C
FIG 3A
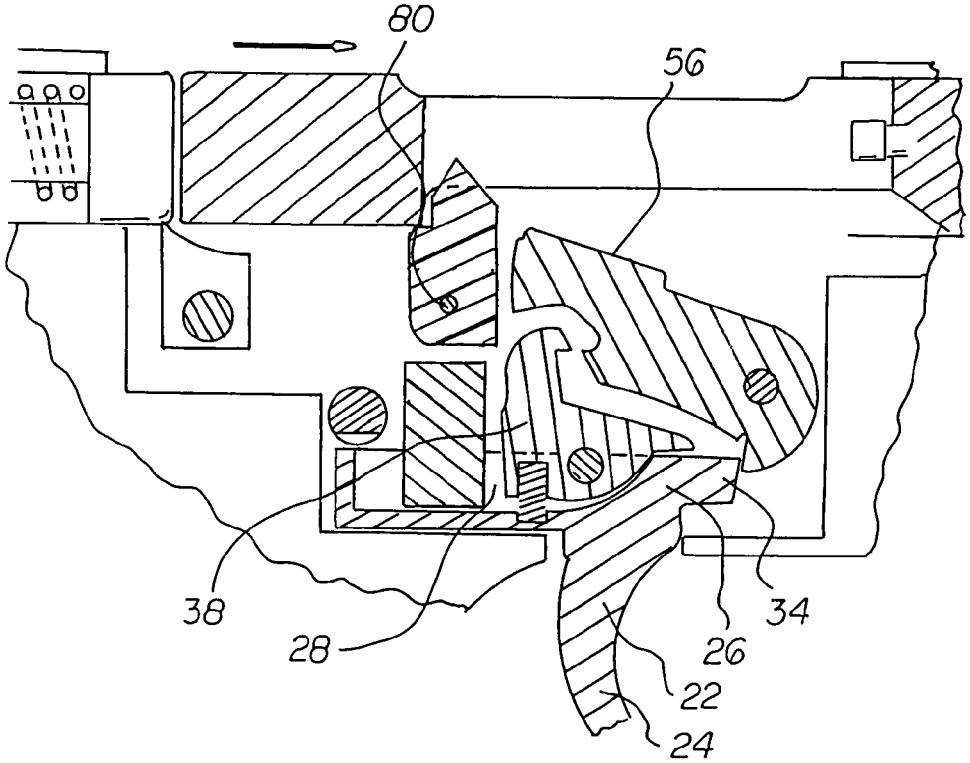

TRIGGER FORWARD DISPLACEMENT SYSTEM AND METHOD

BACKGROUND OF THE INVENTION

1. Field of the Invention

The present invention relates to a trigger forward displacement system and method and more particularly pertains to increasing the cyclic rate of actuating the trigger and discharging a semi-automatic firearm.

2. Description of the Prior Art

The use of accelerating assemblies for semi-automatic firearms is known in the prior art. More specifically, accelerating assemblies for semi-automatic firearms previously devised and utilized for the purpose of accelerating the cyclic firing rate of semi-automatic firearms are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,101,918 issued Aug. 15, 2000 to Akins discloses a method and apparatus for accelerating the cyclic firing rate or a semi-automatic firearm. U.S. Pat. No. 4,023,465 issued May 17, 1977 to Inskip discloses a firearm. U.S. Pat. No. 4,787,288 issued to Miller discloses a rapid fire trigger activator. Lastly, U.S. Pat. No. 4,697,495 issued Oct. 6, 1987 to Beretta discloses a tripping mechanism for the conversion closed-bolt automatic rifles to open-bolt ones.

While these devices fulfill their respective, particular objectives and requirements, the aforementioned patents do not describe a trigger forward displacement system and method that allows increasing the cyclic rate of actuating the trigger and discharging a semi-automatic firearm.

In this respect, the trigger forward displacement system and method according to the present invention substantially departs from the conventional concepts and designs of the prior art, and in doing so provides an apparatus primarily developed for the purpose of increasing the cyclic rate of actuating the trigger and discharging a semi-automatic firearm.

Therefore, it can be appreciated that there exists a continuing need for a new and improved trigger forward displacement system and method which can be used for increasing the cyclic rate of actuating the trigger and discharging a semi-automatic firearm. In this regard, the present invention substantially fulfills this need.

SUMMARY OF THE INVENTION

In view of the disadvantages inherent in the known types of accelerating assemblies for semi-automatic firearms now present in the prior art, the present invention provides an improved trigger forward displacement system and method. As such, the general purpose of the present invention, which will be described subsequently in greater detail, is to provide a new and improved trigger forward displacement system and method which has all the advantages of the prior art and none of the disadvantages.

To attain this, the present invention essentially comprises a semi-automatic firearm. The semi-automatic firearm has a forward end and a rearward end. The semi-automatic firearm is comprised of a receiver. The receiver has a safety selector aperture. The semi-automatic firearm has a barrel and a bolt. The semi-automatic firearm further has a reciprocating loading mechanism and a magazine.

A trigger is provided. The trigger is fabricated of rigid material. The trigger has an outer finger portion and an inner portion. The inner portion has a forward end and a rearward end. The finger portion has a generally forwardly displaced and downwardly projecting arcuate configuration. The rearward inner portion has a seat. The seat comprises a generally rectangularly configured rearward portion. The seat has two upwardly projecting side walls and a rear wall. The walls form an upwardly displaced groove. The groove has a first width. The inner portion of the trigger also has upwardly facing spring recess. The recesses are forward of the groove. The forwardmost end of the inner portion has a beveled sear portion. A mounting pin hole is provided through the inner portion of the trigger. In this manner the trigger is allowed to rotate about the pin hole.

A disconnector is provided next. The disconnector is fabricated of rigid material. The disconnector has a lower attachment portion and an upper portion. A mounting pin hole is provided through the lower attachment portion. The lower attachment portion has a downwardly disposed spring recess. The upper portion has a generally forwardly oriented hooked configuration with a hammer hook.

Provided next is a trigger mounting pin. The trigger mounting pin couples the disconnector and the trigger to the firearm receiver. In this manner the pivotal motion of the trigger and the disconnector is allowed about the trigger pin.

A trigger disconnector spring is provided. The trigger disconnector spring couples the trigger and the disconnector. The spring is nested in the trigger spring recess and the disconnector spring recess and biasing the hammer hook of the disconnector in a forward position.

Next, a hammer is provided. The hammer has a pair of parallel side walls. A thickness is provided between the sidewalls. The hammer has a lower attachment portion and an upper striking portion. A hammer mounting pin aperture is provided through the attachment portion from side to side. The lower portion has a trigger sear catch. The trigger sear engages the trigger and the hammer. The upper portion has a rearwardly displaced disconnector hook receptacle a striking surface. The striking surface is forwardly disposed.

A hammer mounting pin is provided. The hammer mounting pin is sized to couple the hammer and the receiver. In this manner the hammer is allowed to pivot about the hammer mounting pin.

Provided next is a hammer spring. The hammer spring is coupled to the hammer mounting pin. The hammer spring pushes the hammer in a forwardly direction.

Also provided is a cam body subassembly. The cam body subassembly comprises a cam body housing, a cam, and a cam mounting pin. The cam body has a generally rectangular configuration. The cam body has two side surfaces, a rear surface, and a forward surface. The cam body further has a top surface and a bottom surface. The body has a forward portion and a rearward portion. A side to side recess is provided through the rearward portion. In this manner the receiver of the firearm is accommodated. The forward portion has a pair of forwardly projecting cam holders. Through each cam holder is a cam holder pin aperture. The cam has a lower portion. The lower portion has a lower surface. The cam has an upper portion, a front portion, and a rear portion. The lower portion has a generally rectilinear configuration. The upper portion has an upwardly projecting front and rear beveled configuration. In this manner a point is formed. A cam pin aperture is provided in the cam. The cam pin aperture aligns with and mates with the cam holder pin apertures. The cam mounting pin is sized to be received by and mated with the cam holder pin apertures. The cam mounting pin allows the pivotal rotation of the cam about the mounting pin.

Further provided is a safety selector. The safety selector has an outer portion and an inner portion. The outer portion comprises a downwardly displaced lever. The inner portion has a generally solid tubular configuration. The inner portion has a plurality of flat recessed surfaces. The selector is mated with and received by the receiver safety aperture. In this manner the selector is rotatable when in place.

Last provided is a trigger extender. The trigger extender is in a generally rectilinear configuration. The trigger extender has a stepped upper surface and a lower surface. The trigger extender has two parallel side surfaces and parallel front and rear surfaces. The lower surface has a first external side. The first external side has a side to side first width to be received by and mated with the upward trigger groove. The stepped upper surface is flattened and mated with the lower surface of the lower portion of the cam. Mating with the cam is allowed in a rearward position and a disconnected with the cam in the forward position.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved trigger forward displacement system and method which has all of the advantages of the prior art accelerating assemblies for semi-automatic firearms and none of the disadvantages.

It is another object of the present invention to provide a new and improved trigger forward displacement system and method which may be easily and efficiently manufactured and marketed.

It is further an object of the present invention to provide a new and improved trigger forward displacement system and method which is of durable and reliable construction.

An even further object of the present invention is to provide a new and improved trigger forward displacement system and method which is susceptible of a low cost of manufacture with regard to both materials and labor, and which accordingly is then susceptible of low prices of sale to the consuming public, thereby making such trigger forward displacement system and method economically available to the buying public.

Even still another object of the present invention is to provide a trigger forward displacement system and method for increasing the cyclic rate of actuating the trigger and discharging a semi-automatic firearm.

Lastly, it is an object of the present invention to provide a new and improved trigger forward displacement system and method. A semi-automatic firearm has forward and rearward ends. A receiver has a safety selector aperture, a barrel, a reciprocating loading mechanism and a magazine. A trigger having finger and inner portions. The inner portion has a seat with a groove. A disconnector has a hammer hook coupled to the trigger. A trigger mounting pin couples the trigger to the firearm. A trigger disconnector spring couples the trigger and the disconnector. A hammer having an upper striking portion with a disconnector hook receptacle. A hammer mounting pin couples the hammer to the firearm. A hammer spring is coupled to the hammer and hammer mounting pin. A cam body subassembly comprises a cam body housing, a cam and a cam mounting pin. The cam body subassembly is coupled to the firearm. A safety selector is coupled to the firearm. A trigger extender is mated with the upward trigger groove.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a cross sectional elevation of the invention depicting the configuration of the firearm mechanism at the time of discharge of the firearm.

The same reference numerals refer to the same parts throughout the various Figures.

DESCRIPTION OF THE PREFERRED EMBODIMENT

Figure 2A:
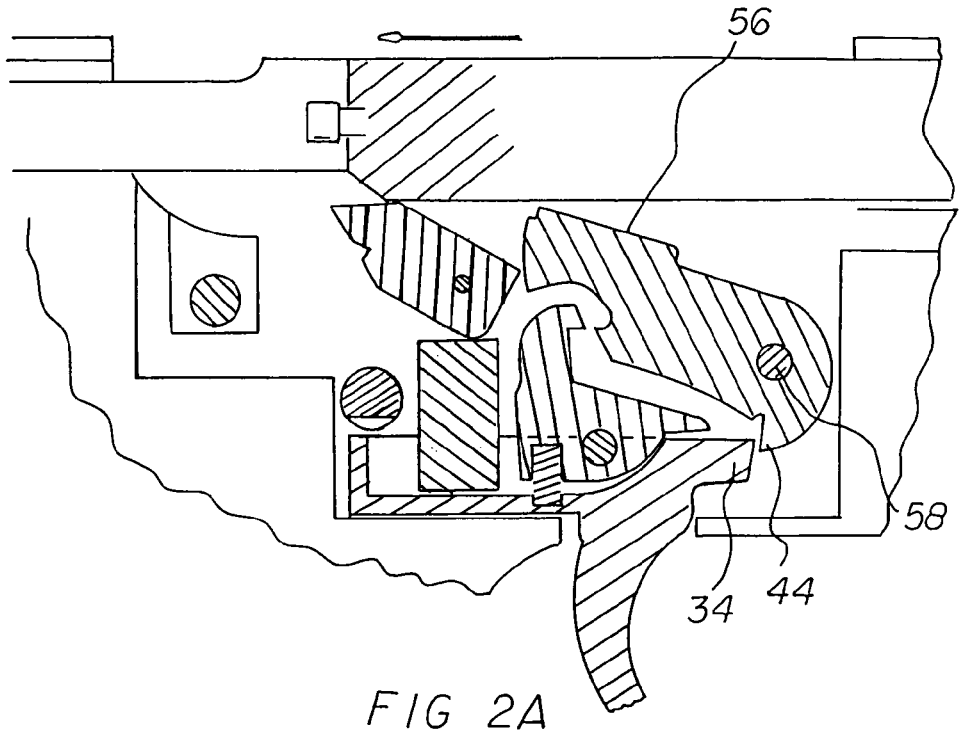
FIG. 2 is a cross sectional elevation of the invention depicting the configuration of the firearm mechanism at the time of the firearm bolt engaging the cam and pushing the trigger forward.
Figure 2B:
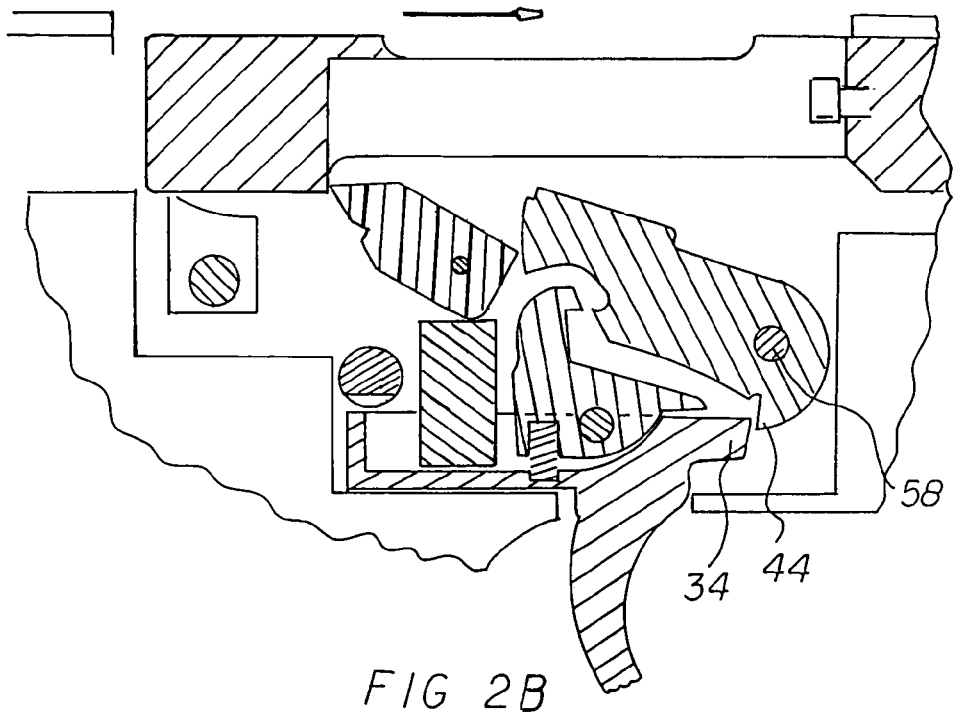
Figure 3:
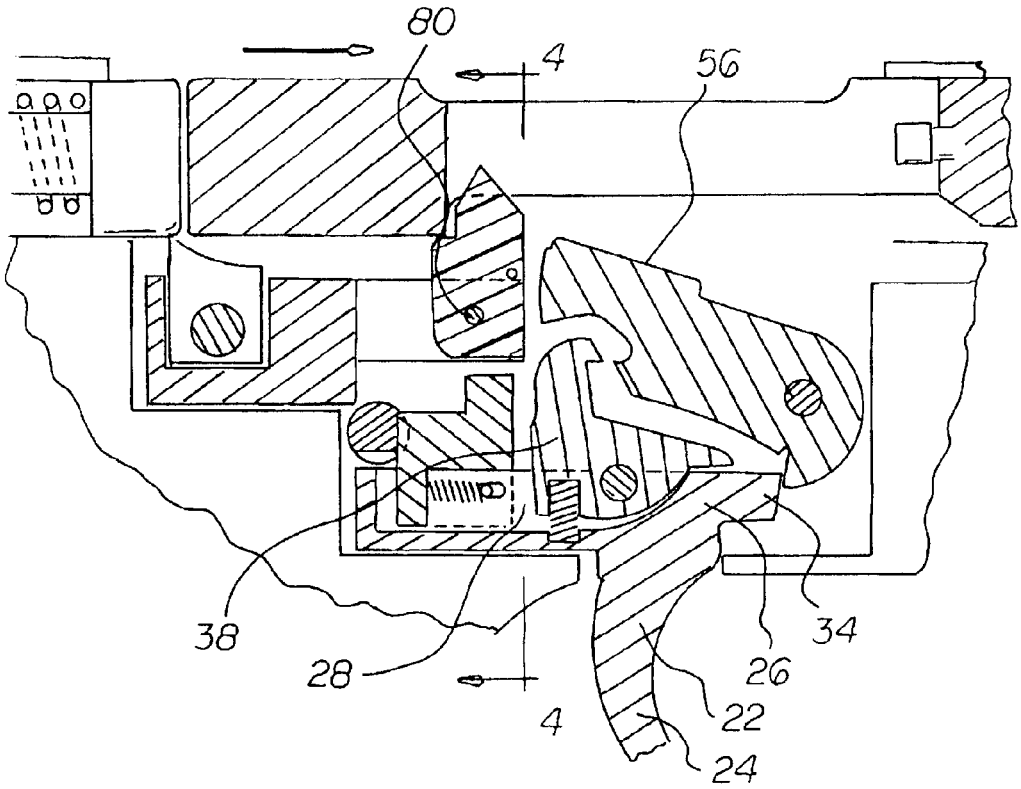
FIG. 3 is a cross sectional elevation of the invention depicting the configuration of the firearm at the time the firearm bolt is in a nearly forward, nearly closed position.
Figure 4:
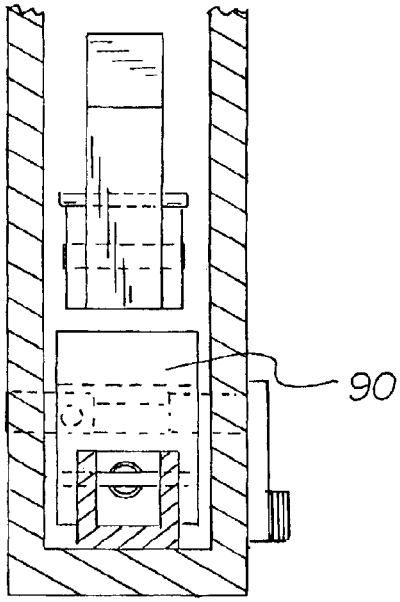
FIG. 4 is front sectional elevation of the invention along line 4-4 of FIG. 3.
Figure 5:
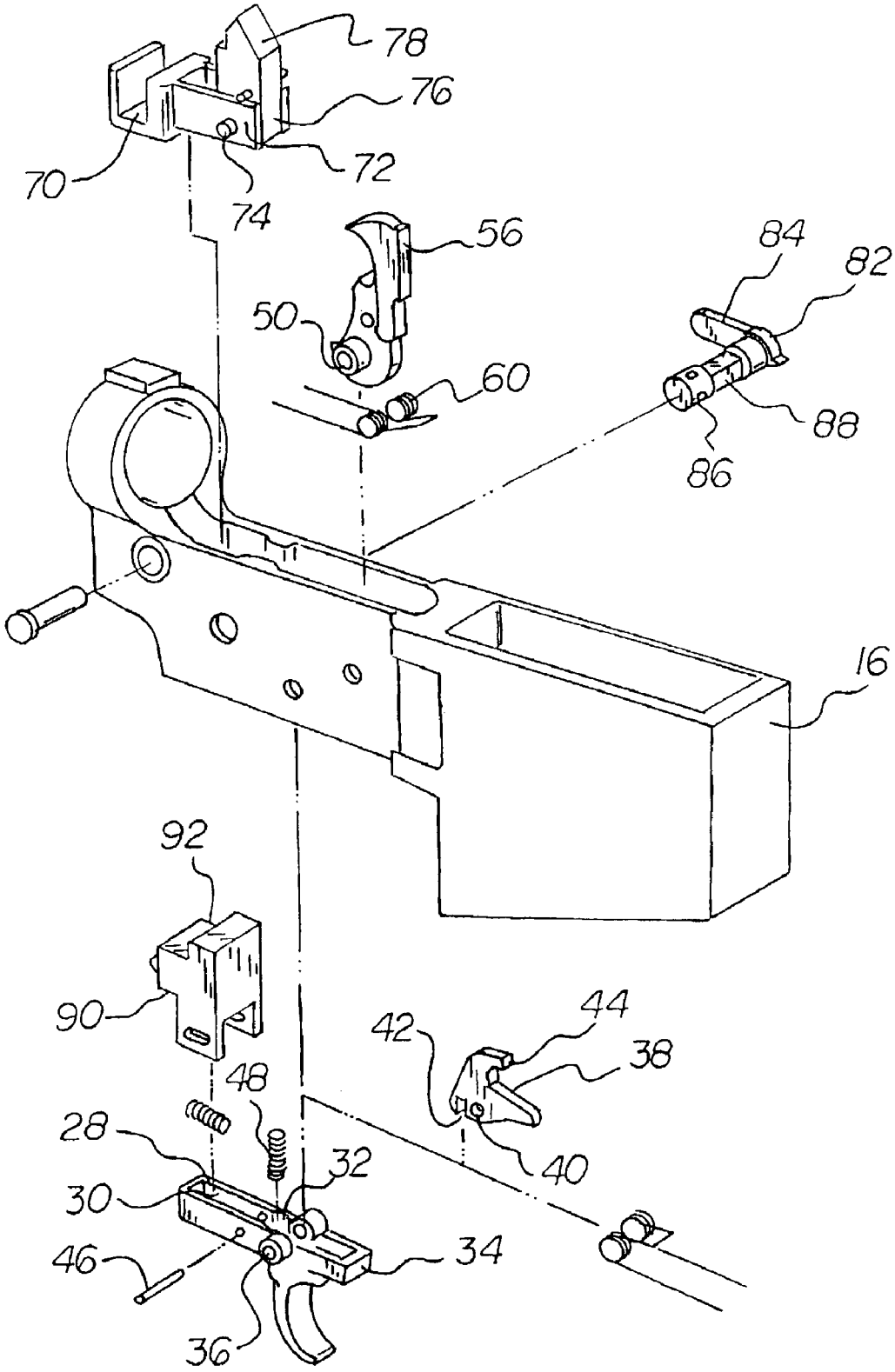
FIG. 5 is an exploded view of the receiver of a firearm, demonstrating the relationships of the various components of the invention with the receiver.

With reference now to the drawings, and in particular to FIG. 1 thereof, the preferred embodiment of the new and improved trigger forward displacement system and method embodying the principles and concepts of the present invention and generally designated by the reference numeral 10 will be described.

The present invention, the trigger forward displacement system and method 10 is comprised of a plurality of components. Such components in their broadest context include a semi-automatic firearm, a trigger, a disconnector, a trigger mounting pin, a trigger disconnector spring, a hammer, a hammer mounting pin, a hammer spring, a cam body assembly, a safety selector, and a trigger extender. Such components are individually configured and correlated with respect to each other so as to attain the desired objective.

First provided is a semi-automatic firearm. The semi-automatic firearm has a forward end 12 and a rearward end 14. The semi-automatic firearm is comprised of a receiver 16. The receiver has a safety selector aperture. The semi-automatic firearm has a barrel and a bolt. The semi-automatic firearm further has a reciprocating loading mechanism 20 and a magazine.

A trigger 22 is provided. The trigger is fabricated of rigid material. The trigger has an outer finger portion 24 and an inner portion 26. The inner portion has a forward end and a rearward end. The finger portion has a generally forwardly displaced and downwardly projecting arcuate configuration. The rearward inner portion has a seat 28. The seat comprises a generally rectangularly configured rearward portion. The seat has two upwardly projecting side walls and a rear wall. The walls form an upwardly displaced groove 30. The groove has a first width. The inner portion of the trigger also has upwardly facing spring recess 32. The recesses are forward of the groove. The forwardmost end of the inner portion has a beveled sear portion 34. A mounting pin hole 36 is provided through the inner portion of the trigger. In this manner the trigger is allowed to rotate about the pin hole.

A disconnector 38 is provided next. The disconnector is fabricated of rigid material. The disconnector has a lower attachment portion and an upper portion. A mounting pin hole 40 is provided through the lower attachment portion. The lower attachment portion has a downwardly disposed spring recess 42. The upper portion has a generally forwardly oriented hooked configuration with a hammer hook 44.

Provided next is a trigger mounting pin 46. The trigger mounting pin couples the disconnector and the trigger to the firearm receiver. In this manner the pivotal motion of the trigger and the disconnector is allowed about the trigger pin.

A trigger disconnector spring 48 is provided. The trigger disconnector spring couples the trigger and the disconnector. The spring is nested in the trigger spring recess and the disconnector spring recess and biasing the hammer hook of the disconnector in a forward position.

Next, a hammer is provided. The hammer has a pair of parallel side walls. A thickness is provided between the sidewalls. The hammer has a lower attachment portion and an upper striking portion. A hammer mounting pin aperture 50 is provided through the attachment portion from side to side. The lower portion has a trigger sear 52 catch. The trigger sear engages the trigger and the hammer. The upper portion has a rearwardly displaced disconnector hook receptacle 54 a striking surface 56. The striking surface is forwardly disposed.

A hammer mounting pin 58 is provided. The hammer mounting pin is sized to couple the hammer and the receiver. In this manner the hammer is allowed to pivot about the hammer mounting pin.

Provided next is a hammer spring 60. The hammer spring is coupled to the hammer mounting pin. The hammer spring pushes the hammer in a forwardly direction.

Also provided is a cam body subassembly 62. The cam body subassembly comprises a cam body housing 64, a cam 66, and a cam mounting pin 68. The cam body has a generally rectangular configuration. The cam body has two side surfaces, a rear surface, and a forward surface. The cam body further has top surface and a bottom surface. The body has a forward portion and a rearward portion. A side to side recess 70 is provided through the rearward portion. In this manner the receiver of the firearm is accommodated. The forward portion has a pair of forwardly projecting cam holders 72. Through each cam holder is a cam holding pin aperture 74. The cam has a lower portion 76. The lower portion has a lower surface. The cam has an upper portion 78, a front portion, and a rear portion. The lower portion has a generally rectilinear configuration. The upper portion has an upwardly projecting front and rear beveled configuration. In this manner a point is formed. A cam pin aperture 80 is provided in the cam. The cam pin aperture aligns with and mates with the cam holder pin apertures. The cam mounting pin is sized to be received by and mated with the cam holder pin apertures. The cam mounting pin allows the pivotal rotation of the cam about the mounting pin.

Further provided is a safety selector 82. The safety selector has an outer portion 84 and an inner portion 86. The outer portion comprises a downwardly displaced lever. The inner portion has a generally solid tubular configuration. The inner portion has a plurality of flat recessed surfaces 88. The selector is mated with and received by the receiver safety aperture. In this manner the selector is rotatable when in place.

Last provided is a trigger extender 90. The trigger extender is in a generally rectilinear configuration. The trigger extender has a stepped upper surface 92 and a lower surface. The trigger extender has two parallel side surfaces and parallel front and rear surfaces. The lower surface has a first external side. The first external side has a side to side first width to be received by and mated with the upward trigger groove. The stepped upper surface is flattened and mated with the lower surface of the lower portion of the cam. Mating with the cam is allowed in a rearward position and a disconnected with the cam in the forward position.

The present invention also comprises a method for automatically actively and positively moving a trigger from a rearward firing position into a forward ready position during the loading cycle of a semi-automatic firearm.

The first step of the method is providing a semi-automatic firearm having a forward end and a rearward end comprising a receiver having a safety selector aperture and a barrel and a bolt and a reciprocating loading mechanism and a magazine.

The next step is providing a trigger fabricated of rigid material having an outer finger portion and an inner portion with the inner portion having a forward end and a rearward end, the finger portion having a generally forwardly displaced and downwardly projecting arcuate configuration, with the rearward inner portion having a seat, the seat comprising a generally rectangularly configured rearward portion with two upwardly projecting side walls and a rear wall, the walls forming an upwardly displaced groove having a first width, the inner portion of the trigger also having upwardly facing spring recess forward of the groove, the forwardmost end of the inner portion having a beveled sear portion, with the inner portion of the trigger having a mounting pin hole there through for allowing the trigger to rotate about the pin hole.

The next step is providing a disconnector fabricated of rigid material having a lower attachment portion and an upper portion, the lower attachment portion having a mounting pin hole there through, the lower attachment portion having a downwardly disposed spring recess, with the upper portion having a generally forwardly oriented hooked configuration with a hammer hook.

The next step is providing a trigger mounting pin for coupling the disconnector and the trigger to the firearm receiver to allow the pivotal motion of the trigger and the disconnector about the trigger pin.

The next step is providing a trigger disconnector spring for coupling the trigger and the disconnector, the spring being nested in the trigger spring recess and the disconnector spring recess and biasing the hammer hook of the disconnector in a forward position.

The next step is providing a hammer having a pair of parallel side walls and a thickness there between, the hammer having a lower attachment portion and an upper striking portion with the attachment portion having a hammer mounting pin aperture there through from side to side, with the lower portion having a trigger sear catch to engage the trigger and the hammer, the upper portion having a rearwardly displaced disconnector hook receptacle and a forwardly disposed striking surface.

The next step is providing a hammer mounting pin sized to couple the hammer and the receiver to allow the hammer to be pivot able about the hammer mounting pin;

The next is providing a hammer spring coupled to the hammer mounting pin, the hammer spring pushing the hammer in a forwardly direction.

The next step is providing a cam body subassembly comprising a cam body housing and a cam and a cam mounting pin, the cam body having a generally rectangular configuration with two side surfaces and a rear surface and a forward surface and a top surface and a bottom surface, the body having a forward portion and a rearward portion, the rearward portion having a side to side recess there through sized to accommodate the receiver of the firearm, the forward portion having a pair of forwardly projecting cam holders, with each cam holder having a cam holder pin aperture there through, the cam having a lower portion with a lower surface and an upper portion and a front portion and a rear portion, the lower portion having a generally rectilinear configuration and the upper portion having an upwardly projecting front and rear beveled configuration forming a point, the cam having a cam pin aperture there through to align with and mate with the cam holder pin apertures, the cam mounting pin sized to be received by and mated with the cam holder pin apertures, with the cam mounting pin allowing the pivotal rotation of the cam about the mounting pin.

The next step is providing a safety selector having an outer portion and an inner portion, the outer portion comprising a downwardly displaced lever with the inner portion having a generally solid tubular configuration with a plurality of flat recessed surfaces, the selector being mated with and received by the receiver safety aperture allowing the selector to be rotatable when in place.

The penultimate step is providing a trigger extender having a generally rectilinear configuration with an upper surface and a lower surface and two parallel side surfaces and parallel front and rear surfaces with the lower surface having a first external side to side first width to be received by and mated with the upward trigger groove, the upper surface being flattened and mated with the lower surface of the lower portion of the cam.

The final step is automatically actively and positively moving the trigger of a semi-automatic firearm from the rearward fire position to the reset, unpulled and ready to fire position by the reciprocating function of the firearm mechanism, such that, once reset, the operator's finger pressure is prevented from being able to move the trigger in the rearward direction toward the fire position until the firearm reciprocating mechanism has reached an approximately closed, ready to fire position, with such means also preventing the binding or displacement of the reciprocating loading mechanism by a pressure placed on the trigger.

What is claimed as the invention is an accelerating assembly to effectively increase the cyclic rate at which the operator may actuate the trigger and discharge a semi-automatic firearm. The firearm is a typical semi-automatic firearm containing a reciprocating member which is used to load a round of live ammunition into the chamber, to position the components of the action to be ready to effect the discharge of the loaded round in response to a pull of the trigger by the operator, and to unload the spent cartridge from the chamber of the firearm after firing. The accelerating mechanism incorporates a plurality of parts designed to allow the reciprocating member of the firearm, said reciprocating member including a bolt, bolt carrier, slide or part of another name depending upon the firearm involved.

On the rearward travel of the reciprocating member the mechanism resets the trigger to the forward, ready-to-fire position. The trigger reset may be against the rearward pressure on the trigger applied by the operator's finger. The trigger is positively held in the forward, ready-to-fire position until such time as the reciprocating member has reversed direction and has reached the nearly-fully-forward position where it is safe to allow discharge of the firearm.

When the nearly-fully-forward, or nearly closed, position is reached, the accelerating mechanism disengages and allows the operator to again pull the trigger rearward. This cycle will be repeated the firearm to be discharged at a accelerated rate. The semi-automatic status of the firearm is retained as the firearm only discharges one round of ammunition for each pull of the trigger.

The present invention relates generally to firearms. Specifically, the present invention relates to methods and structural arrangements by which to accelerate the cyclic firing rate of a semi-automatic firearm. The method utilized by this invention is the resetting of the trigger to the forward ready-to-fire position by use of the reciprocating mechanism of the firearm. The mechanism moves the trigger from the fire, rearward, position into the ready-to-fire, forward, position. The trigger is held in the ready-to-fire position until the firearm has completed the discharge, extraction, reloading sequence. Once the sequence is complete and the bolt is in the nearly-fully-forward, or nearly closed position, and then mechanism disengages the trigger thereby allowing the operator to pull the trigger and repeat the sequence. As the trigger is actively moving forward and rearward for each shot fired, and as the shooter must in fact pull the trigger each time, the semi-automatic status of the firearm is preserved.

Fully automatic firearms, commonly referred to as "machine guns" are designed such that they will continue to fire automatically so long as the trigger of the firearm is held in the rearward position. Legally any firearm that discharges more than one shot by a single function of the trigger is a machine gun. While machine guns are legal for civilian ownership in the United States, further manufacture of machine guns for civilian sale was outlawed in May of 1986 thereby fixing the quantity of machine guns available to the civilian market. Due to this "fixed supply" in the face of increasing demand, machine gun prices have continued to rise over time, currently reaching levels that are out of reach for many consumers. Additionally machine guns are regulated by the National Firearms Act which imposes transfer taxes, registration requirements, and other administrative burdens on owners of machine guns. Given this combination of economics and regulatory requirements, many inventors have devised ways to increase the cyclic rate of a semi-automatic firearm without causing the firearm to become a machine gun by violating the "one round per function of the trigger" rule.

One prior known attempt to enhance the cyclic firing rate of a semi-automatic firearm was commonly known as the "Hell Fire System". The Hell Fire System, or HFS, constitutes a spring biased paddle that engages the rear of the trigger and continually urges it in a forward direction. To operate the HFS, on balances the firearm by supporting it with one hand grasping the fore-end of the stock and with the hand having the trigger-finger positioned so the trigger finger is within the trigger guard of the firearm but that hand is otherwise not touching the firearm. The hand with the trigger finger is held in a fixed position. The operator then uses the hand that grasps the fore-end of the firearm to pull the firearm away from his body causing the trigger to contact that approximately statically held trigger finger and with continued pulling by the first hand, the trigger finger is made to pull the trigger. When the firearm discharges and recoils, the entire firearm moves rearward which also moves the trigger rearwardly away from the approximately statically held trigger finger. Throughout this sequence the operator is continually pulling the firearm away from him with the hand on the fore-end but his attempt to do so is briefly interrupted by the recoil impulse.

As the recoil impulse subsides the operator's continued pulling will once again move the firearm away from the body causing the trigger to impact the trigger finger and the process repeats. Accuracy and reliability suffered greatly as the firearm could not be shouldered and the technique required practice to develop.

Another known method is the Akins patent (U.S. Pat. No. 6,101,918) referenced by this patent which takes the HFS principle and renders it in a mechanically controlled form that is accurate and reliable. By allowing the entire firearm frame, action and barrel to move within the stock of the firearm, Akins permits the firearm to be shouldered, the trigger finger to be absolutely statically held, and still employ the general HFS principle of allowing the recoil to move the trigger away from the trigger finger. While accurate and reliable, the Akins invention is best suited to firearms in which the receiver of the firearm is coupled to a unitary grip and buttstock so that the shooter's trigger-finger hand can be held stationary relative to the buttstock while the receiver moves within the grip-stock unit.

Many military style arms have a separate pistol grip and buttstock in their military configuration. In order to use the Akins invention these firearms would have to be fitted with a unitary grip-stock combination such as a thumb-hole stock. Therefore, many firearms such as the AR15, L1A1, AK47, etc. would not be able to employ the Akins invention in their original separate-pistol-grip configuration.

Additionally it appears that the Akins invention requires considerable modification to the host firearm in order to permit the receiver to move within the stock and provide a means to urge the receiver forward again after the recoil impulse has subsided.

Lastly, the Inskip patent, (U.S. Pat. No. 4,023,465) also referenced by this patent, appears intended to regulate the rate of fire of a machine gun by allowing the operator to control the rate of fire of the firearm by the pulling pressure on the trigger. The exemplary embodiment of Inskip's invention uses the cycling bolt carrier of an AK47 to move the trigger of the firearm to the forward ready-to-fire position, and then locks the trigger in that position until the bolt carrier returns to battery at which time the trigger is unlocked and the operator again allowed to pull it. According to Inskip's patent disclosure, if the operator pulls the trigger lightly the cycle will be slowed and if the trigger is pulled firmly the cyclic rate will increase. The difference between the present invention and the Inskip invention is that the Inskip mechanism used to allow the bolt carrier to force the trigger forward allows the operator's trigger finger pressure to be transmitted vertically to the bolt carrier during the entire latter portion of the bolt carrier's cycle. Inskip allows the operator's trigger finger pressure to cam the bolt carrier upward causing friction between the bolt carrier and the adjacent surfaces of the receiver of the firearm. The period when the carrier approaches, then reaches its fully rearward point and reverses directions is a vulnerable point with regard to stoppages as the bolt carrier is in a lower kinetic energy state and more easily halted. Since the transmission of the trigger-finger force persists during this period the resulting friction and displacement is sufficient to cause the bolt carrier to bind and cease travel in some firearms causing a highly undesirable stoppage. The present invention eliminates this problem as follows.

It is, therefore, a primary object of the invention to provide an improved method and apparatus by which the cyclic rate of a semi-automatic firearm can be accelerated by using the reciprocating member of a semi-automatic firearm to reset the trigger to the ready-to-fire position. The mechanism described in this application allows the operator's trigger finger pressure to be overcome during a relatively high energy portion of the reciprocating member's travel. After resetting the trigger, the trigger finger pressure is borne by the accelerating mechanism and is unable to continue to transmit force to the reciprocating member. The trigger is held in the ready-to-fire position until the loading cycle is completed and the gun is safe to fire.

It is another object of the present invention to provide an improved method and apparatus, as above, that will increase the cyclic firing rate without requiring the receiver of the firearm to be modified, however, a version requiring modification of the receiver is also described.

It is another object of the present invention to provide an improved method and apparatus, as above, that will increase the cyclic firing rate without causing the firearm to fall into the legal definition of a machine gun.

After the trigger has been pulled and the hammer has fallen, impacting the firing pin and igniting a round of ammunition, the bolt is driven rearward by the firing action and in so moving will first pivot the hammer to the cocked rearward position whereupon it will engage the disconnector. As the bolt continues its rearward progress, it will secondly contact the cam pivoting it rearward until such time as the bottom surface of the forward portion of the bolt is allowed to pass over the cam freely. In rotating to the rear (more than 45 degrees) the bottom surface of the cam has pressed downward on the trigger-extension forcing the rear of the trigger down thereby moving forward the surface of the trigger that the operator's finger engages. In resetting the trigger the disconnector ceases to engage the hammer. The hammer then continues to be held to the rear by the forward engagement surface of the trigger engaging the notch in the sear notch at the bottom of the hammer. The nature of the cam and its action is such that the trigger is held firmly down/forward potentially against the finger pressure of the operator, but the force of the operator's finger is not transmitted to the bolt as an upward displacing force. Such upward displacing force would bind the bolt and abnormally terminate the firing cycle. Ultimately the bolt reaches the mechanical limit of its rearward motion (limited by the buffer spring which is not illustrated) and the bolt begins moving forward by force of said spring. As the bolt nears the end of its forward movement the face of the trailing bottom surface of the bolt (which is lower with regard to the cam than the bottom surface of the forward portion of the bolt) contacts a now vertical surface of the cam rotating the cam forward 8 or more degrees (the impact may rotate the cam further than is mechanically imperative). After the forward rotation of the cam, if finger pressure is applied to the surface of the trigger that is engaged by the operator's finger, the resulting upward force of the trigger-extension against the flat surface of the cam currently at an angle to the trigger-extension will force the cam to finish rotating forward to it's original position. The applied finger pressure will then be permitted to fully pivot the trigger to the point that it releases the hammer and begin the firing sequence again.

The disclosed invention may also be crafted by eliminating the cam body and instead fashioning the cam and firearm receiver in such a way as to allow the cam to be pinned in place directly to the receiver.

It is intended that the effect of the disclosed invention be able to be optionally selected or deselected by operating the selector-cam and by configuring the trigger extension to be able to move forward and rearward within/upon the rear of the trigger by means of a spring bias that competes with engagement surfaces machined into the selector-cam. Moving the trigger-extension forward or rearward would allow or prevent the cam from contacting the top/bearing surface of the trigger-extension by having the top/bearing surface of the trigger-extension crafted so that it has a lower and higher part, and such that when the lower part is beneath the cam the cam does not make contact with the top/bearing surface of the trigger-extension as the cam moves through its range of motion, thereby allowing or preventing the cam from resetting the trigger.

The invention can be effected without the provision of a selector whereupon the effect of the invention will be continually present unless the apparatus is removed from the firearm.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of accelerating the firing cycle of a semi-automatic firearm comprising the steps of:

depressing a firearm trigger with a finger to discharge the firearm;

activating a reciprocating mechanism within the firearm that causes a cam, in a single rotational motion of the cam, to simultaneously push the trigger forward into a ready to fire position and hold the trigger forward in the ready to fire position until the reciprocating mechanism has reached an approximately closed, ready to fire position.

* * * * *